US011725618B2

(12) United States Patent
Bärow et al.

(10) Patent No.: US 11,725,618 B2
(45) Date of Patent: Aug. 15, 2023

(54) ARRANGEMENT

(71) Applicant: Woodward L'Orange GmbH, Stuttgart (DE)

(72) Inventors: Enrico Bärow, Stuttgart (DE); Ingmar Berger, Stuttgart (DE); Michael Nitsche, Schwieberdingen (DE)

(73) Assignee: Woodward L'Orange GmbH (DE)

( * ) Notice: Subject to any disclaimer, the term of this patent is extended or adjusted under 35 U.S.C. 154(b) by 302 days.

(21) Appl. No.: 16/480,484

(22) PCT Filed: Jan. 25, 2018

(86) PCT No.: PCT/EP2018/000035
§ 371 (c)(1),
(2) Date: Jul. 24, 2019

(87) PCT Pub. No.: WO2018/141473
PCT Pub. Date: Aug. 9, 2018

(65) Prior Publication Data

US 2019/0390639 A1 Dec. 26, 2019

(30) Foreign Application Priority Data

Feb. 2, 2017 (DE) ..... 102017000911.2

(51) Int. Cl.
*F02M 61/12* (2006.01)
*F02M 51/06* (2006.01)
(Continued)

(52) U.S. Cl.
CPC ..... *F02M 61/12* (2013.01); *F01M 9/103* (2013.01); *F02M 35/10216* (2013.01);
(Continued)

(58) Field of Classification Search
CPC .. F02M 35/10216; F02M 47/02; F02M 51/06; F02M 61/08; F02M 61/10;
(Continued)

(56) References Cited

U.S. PATENT DOCUMENTS 5,448,979 A * 9/1995 Clarke ..... F01B 7/02 123/507
6,726,121 B1 * 4/2004 Kienzler ..... F02M 47/027 239/96
(Continued)

FOREIGN PATENT DOCUMENTS

DE 102008042154 3/2010
DE 102009002742 11/2010
(Continued)

OTHER PUBLICATIONS

PCT International Search Report and Written Opinion in International Application No. PCT/EP2018/000035, dated Apr. 17, 2018, 20 pages with english translation.
(Continued)

*Primary Examiner* — John Kwon
*Assistant Examiner* — Johnny H Hoang
(74) *Attorney, Agent, or Firm* — Fish & Richardson P.C.

(57) ABSTRACT

Arrangement comprising: a chamber that is formed between a first receptacle and a second receptacle for a rod-shaped element, wherein the receptacles open out to the chamber on opposite end-face sides thereof; a rod-shaped element that is accommodated in the receptacles via a respective section with radial play, in this regard with a receptacle radial play, the rod-shaped element passing through the chamber; and an annular body that is situated in the chamber and through which the rod-shaped element passes with radial play, in this regard an annular body radial play, wherein the annular body radial play is less than the receptacle radial play, wherein the
(Continued)

arrangement has a first media side and a second media side that are connected to the chamber via the first receptacle and second receptacle, respectively, wherein the annular body is provided to be pressed into contact against an end-face side of the chamber.

15 Claims, 3 Drawing Sheets

(51) Int. Cl.

| | |
|---|---|
| ***F02M 61/16*** | (2006.01) |
| ***F02M 63/00*** | (2006.01) |
| ***F01M 9/10*** | (2006.01) |
| ***F02M 35/10*** | (2006.01) |

(52) U.S. Cl.
CPC ..... *F02M 51/06* (2013.01); *F02M 61/16* (2013.01); *F02M 63/00* (2013.01)

(58) Field of Classification Search
CPC ..... F02M 61/12; F02M 61/16; F02M 63/00; F01M 9/103; F02B 33/40; F02B 43/10; F02B 2201/04
USPC ..... 123/445
See application file for complete search history.

(56) References Cited

U.S. PATENT DOCUMENTS

| | | | | |
|---|---|---|---|---|
| 6,874,705 | B2 * | 4/2005 | Parche | F02M 61/205 239/96 |
| 7,942,349 | B1 * | 5/2011 | Meyer | F02M 61/12 123/294 |
| 2004/0026645 | A1 * | 2/2004 | Hanneke | F02M 63/0015 239/585.1 |
| 2005/0077378 | A1 * | 4/2005 | Kropp | F02M 61/205 239/88 |
| 2010/0006679 | A1 * | 1/2010 | Manubolu | F16K 31/061 239/585.5 |
| 2010/0288239 | A1 * | 11/2010 | Morris | F02M 51/0603 239/102.2 |
| 2011/0042490 | A1 | 2/2011 | Gunji et al. | |
| 2015/0337786 | A1 * | 11/2015 | Sun | F02M 63/0068 239/584 |
| 2019/0186263 | A1 * | 6/2019 | Gaj-Jablonski | F02B 75/24 |

FOREIGN PATENT DOCUMENTS

| | | |
|---|---|---|
| DE | 102012210625 | 12/2013 |
| EP | 3018340 | 5/2016 |
| WO | WO2005066487 | 7/2005 |

OTHER PUBLICATIONS

PCT International Preliminary Report on Patentability in International Application No. PCT/EP2018/000035, dated Aug. 15, 2019, 17 pages with english translation.

* cited by examiner

ARRANGEMENT

CROSS-REFERENCE TO RELATED PATENT APPLICATIONS

This application is a U.S. National Stage of and claims the benefit of priority to PCT/EP2018/000035, filed Jan. 25, 2018, which claims the benefit of German Application No. 102017000911.2, filed Feb. 2, 2017, the contents of which are incorporated by reference herein.

TECHNICAL FIELD

The present disclosure relates to an arrangement according to claim 1.

BACKGROUND

In fuel injectors, rod-shaped elements such as nozzle valve elements or hold-down elements must sometimes be guided through various housing elements with narrow gaps in sections, in particular to minimize leakage rates along the particular guide. In particular when it is also necessary to keep different media, such as combustion gas and liquid fuel or control fluid, that are present at opposite ends of such a guide separate from one another, such small gap sizes are desired. However, the problem arises that such rod-shaped elements tend to jam even with a slight shift of the guiding housing elements.

SUMMARY

FIG. 1 shows an arrangement of a fuel injector from the prior art which provides a multipart design of a rod-shaped element to prevent it from jamming. However, such a design is disadvantageous in that the number of parts is increased. In addition, jamming is not consistently reliably avoided, since the guide gaps, which are still narrow with the substantial length, tend to clog (layer deposition).

On this basis, the object of the present disclosure is to provide an arrangement with which the disadvantages of the prior art may be overcome.

This object is achieved by an arrangement having the features of Claim 1.

Advantageous refinements and embodiments are set forth in the further claims.

According to the disclosure, an arrangement is proposed that is applicable, for example, for a fuel injector, and thus a fuel injection device or an internal combustion engine. A fuel injector having the arrangement may in particular be a dual-fuel fuel injector, for example for combustion gas (such as natural gas, specialty gas, landfill gas, hydrogen, etc.) and liquid fuel (such as diesel fuel, bio-oil, or heavy fuel oil). Within the scope of the disclosure, a fuel injector or a fuel injection device having the arrangement may be provided for a large engine, for example in a motorized vehicle such as a ship, a locomotive, a special purpose vehicle, or a utility vehicle, or for a stationary unit, for example, such as a cogeneration unit or an (emergency) power generator, also for industrial applications, for example.

The proposed arrangement has a chamber or a delimited space that is formed between a first and a second (through) receptacle for a rod-shaped element. The chamber may have a cylindrical shape, for example, or alternatively a dumbbell shape, for example, thus forming, for example, two chamber parts that communicate via the dumbbell shaft. In general, the cross section of the chamber as well as of the receptacles is preferably circular.

The chamber and the receptacles, which open out to the chamber, in particular open into the chamber, on opposite end-face sides thereof, are preferably formed in a housing of the arrangement, which in particular may have a multipart design. The chamber may preferably be formed by two adjoining housing elements, for example also by one or two blind holes, each of which is created in a boundary surface of a housing element. One respective housing element may, for example, also form one of the receptacles, which has the advantage of extremely simple manufacture. The receptacles for the rod-shaped element are each preferably a through receptacle, for example a borehole (in a housing element), generally with a preferably circular cross section, and also preferably each coaxially or concentrically aligned with the chamber in their direction of longitudinal extension.

Within the scope of the proposed arrangement, the arrangement also includes a rod-shaped element that is accommodated in the receptacles with (relatively large) radial play via one section each, in this regard in particular with a receptacle radial play, and the rod-shaped element, in particular in its direction of longitudinal extension, passing through the chamber (i.e., from end-face side to end-face side or from opening to opening). The rod-shaped element may generally be a round rod-shaped element or round rod-shaped element in sections, for example a stilt element (hold-down element), a piston element, or a nozzle valve element such as a nozzle needle (in particular a fuel injector), for example also an anchor rod (for example, a pilot valve of the fuel injector). Within the scope of the present disclosure, the rod-shaped element may also have a nozzle valve element, a piston section, and a stilt section, in particular in the stated sequence. For example, the nozzle valve element section or also the stilt section may form the rod-shaped element that passes through the chamber.

In addition, the arrangement includes an annular body, for example having the approximate shape of an annular disk or formed as such, which is situated in the chamber and preferably surrounds the rod-shaped element with (relatively less) radial play (with respect to the relatively large radial play of the rod-shaped element in the receptacles, i.e., the receptacle radial play). In this regard, the rod-shaped element in particular passes through the annular body, also in particular with the (relatively less) radial play, i.e. in this regard an annular body radial play, preferably also aligned coaxially with the annular body. By use of the arrangement, the annular body is (longitudinally) displaceable in the chamber, also in particular independently of the rod-shaped element. Furthermore, it is noted that the annular body radial play (relatively less radial play) within the scope of the proposed arrangement or within the scope of the present disclosure in particular is less than the receptacle radial play (relatively large radial play).

Within the scope of the proposed arrangement, the arrangement also has a first media side and a second media side which are connected to the chamber via the first receptacle and second receptacle, respectively, in particular which communicate with the chamber via the first and second receptacles; i.e., the first media side, in particular connected via the first receptacle, preferably communicates with the chamber via the first receptacle, and the second media side, in particular connected via the second receptacle, preferably communicates with the chamber via the second receptacle (in each case via the radial gap around the rod-shaped element in the respective receptacle).

The first media side is a combustion gas side, for example, and the second media side is a control fluid side, for example (in particular a control oil side), preferably for one fuel injector in each case. When the arrangement is used, the media on the respective media sides are provided under pressure, in particular with preset (media) pressure levels. In particular a predetermined media pressure difference between the media sides may thus be provided.

In the arrangement according to the disclosure, the annular body is now provided for or capable of being pressed into contact (in particular acted on by media pressure) against an end-face side of the chamber or coming into contact with an end-face side of the chamber, in particular sealing against media entry into the chamber at the associated opening (the opening of this end-face side). In terms of a (suitable) media pressure impingement, within the scope of the present disclosure on at least at one of the media sides of the arrangement, for example with an (appropriately controlled) media pressure difference between the first and the second media sides, the annular body may preferably be shifted; i.e., the annular body is shifted by media pressure impingement, in particular shifted in the longitudinal direction, i.e., displaced along the rod-shaped element and pressed into contact against an end-face side. This position may then be reliably maintained, at least as long as the media pressure conditions remain appropriately controlled or prevail.

With the arrangement according to the disclosure, it is thus advantageously possible to achieve reliable sealing, in particular self-sealing, at the opening, and thus also an intentional media separation between the first and the second media sides. In addition, with the arrangement the radial gaps around the rod-shaped element may be larger in the receptacles than the small guide gaps in the prior art, since when the annular body is pressed into contact against an end-face side with media pressure impingement, enough adhesive force may also be transmitted to the chamber wall that the rod-shaped element may advantageously be guided through the annular body. Transverse forces may thus also be introduced into a housing element of the arrangement via the annular body at the end-face side.

When the annular body is allowed sufficient radial play in the chamber (as is generally provided within the scope of the present disclosure), the annular body may also be radially displaced if necessary, and may thus also easily compensate for a radial offset between various receptacles of the rod-shaped element (analogously to the above-mentioned offset of the guides in the prior art); the annular body preferably acted on by media pressure is thus supported on the end-face side of the chamber in a floating manner. In this way, a rod-shaped element, in particular having a nozzle valve element section, a piston section, and a stilt section, may now advantageously also have a one-piece design. Since the annular body still needs to have only small dimensions in the direction of passage through the chamber (from end-face side to end-face side), i.e., in the direction of longitudinal extension, reliable flushing of the passage gap having the annular body radial play (relatively small radial play) over its length is also made possible, and layer deposition is thus effectively prevented; in addition, the small mass of the annular body to be moved is conducive to an excellent response characteristic with regard to displacement, preferably acted on by media pressure.

In a first embodiment of the arrangement, in particular formed with a single annular body, the annular body may be provided for or capable of coming into contact with one or the other end-face side of the chamber (pressed into contact against same, and sealing against media entry into the chamber at the associated opening), in particular acted on by media pressure. In such an embodiment the annular body may be an annular disk, for example. With such a design, the annular body may also be pressed against one or the other end-face side (in particular acted on by media pressure), so that the rod-shaped element may in turn also be guided through the annular body on the one or the other end-face side.

In another preferred embodiment of the arrangement, the arrangement has a further or second annular body which is likewise situated in the chamber and which, analogously to the (first) annular body described above, surrounds the rod-shaped element with radial play or annular body radial play (relatively less radial play than that of the rod-shaped element in the receptacles, i.e., receptacle radial play), wherein the further annular body is situated opposite from the (first) annular body in the direction of passage through the chamber, i.e., the direction of longitudinal extension. In this embodiment, the further annular body, through which the rod-shaped element in particular also passes (with annular body radial play), in the chamber is also preferably acted on by media pressure and also longitudinally displaceable, also in particular independently of the rod-shaped element.

With this arrangement, the first annular body in particular is provided to come into contact with an end-face side of the chamber (pressed against the end-face side), preferably acted on by media pressure, in particular to seal against media entry into the chamber at the associated opening, and the further or second annular body is provided to come into contact with the other end-face side (pressed against same), preferably acted on by media pressure, in particular to seal against media entry into the chamber at the associated opening. Here as well, the media separation may be reliably achieved, and sealing or self-sealing at both openings may be realized.

Analogously to the embodiment described above, it may also once again be provided to allow enough radial play in the chamber for the particular annular body so that any radial offset of the receptacles relative to one another may be compensated for (by radial movement of the annular bodies in the chamber). In addition, the rod-shaped element may be guided by both annular bodies, which then allows transverse forces to be introduced into a housing element in particular with media pressure impingement or pressing against the opposite end-face sides of the chamber. The quality of the guiding may be even further improved due to two guided sections on the rod-shaped element.

In particular with an arrangement as described above, it is also provided that a line path is guided to the chamber in communication with same or connected thereto; the chamber is connected to a third media side of the arrangement, in particular may be brought into communication with the third media side of the arrangement, via the line path. The line path is preferably radially guided to the chamber, and is easily produced, for example, as a groove in a housing element boundary surface or as a (radial) borehole. On the third media side, for example a third pressure-impinged medium such as barrier fluid (when used with an injector) may be guided to the chamber, which assists with the media separation of the first and second media sides. For this purpose, the medium of the third media side may, for example, have a higher pressure level than that of the first and second media sides.

In such an arrangement with a third media side, it is in particular provided to be able to press the first and the second annular bodies into contact with an end-face side via the pressure-impinged medium of the third media side. For this purpose, a media inlet of the third medium in the chamber may be provided, for example, (in a longitudinally central area) between the first and second annular bodies, or also at other positions.

It is noted that within the scope of the present disclosure it may generally also be provided to press the (or each) annular body against a (or each) end-face side of the chamber by means of a force, the force not resulting from, or not only from, media pressure impingement (of the particular annular body). Examples of such a force include an elastic force, a magnetic force, or some other force that is introduced into the particular annular body. For the annular body to be acted on by such a force, the arrangement may have an appropriate force-exerting means or a source of force, for example situated inside or outside the chamber, for example a spring-elastic element such as a compression spring or a tension spring or, for example, formed by at least one annular body itself (for example, by its material, such as a magnetic material or designed as a magnet). The force-exerting means or the source of force may provide, for example, an auxiliary force, for example to ensure or bring about the contact of the annular body/bodies with an end-face wall/the end-face walls of the chamber only in the state without media pressure. However, it may also be provided that the annular body/bodies, independently of the operating situation, is/are always pressed into contact against an end-face side of the chamber and in particular solely by the (pressure) force-exerting means or the source of force, in particular also continuously or permanently, for example (in particular independently of media pressure).

In particular in one embodiment in which at least one of the annular bodies is to be pressed into contact against an end-face side of the chamber, acted on by media pressure in an intended displacement direction, this annular body may have a contact surface on one longitudinal end (end-face side), and a pressure shoulder surface with a comparatively larger surface on an opposite longitudinal end (other end-face side). The displacement behavior of the annular body may be easily influenced in this way, i.e., by developing a surface ratio-related (contact surface/pressure shoulder surface) pressure difference characteristic which, as intended, always promotes a displacement against the end-face wall of the chamber provided for this purpose. To this end, the annular body may have a bevel or an offset on the pressure shoulder surface having an enlarged surface, while the contact surface, for example, is flat over the entire surface. If two annular bodies are to be brought into contact at opposite end-face sides, both annular bodies may be designed in such a way that the pressure shoulder surfaces preferably point toward one another.

In particular to avoid the situation that the annular body or bodies is/are temporarily situated in the chamber in an undefined manner, for example during a transition from a pressureless state into a state acted on by media pressure, a spring-elastic element that is pressed against the annular body or also the further annular body may also be situated in the chamber. For example, such a spring-elastic element, such as a (coil) compression spring, presses the particular annular body into contact against one of the openings. In the case of two annular bodies, these are pressed, for example, against the oppositely situated openings, the spring-elastic element being supported, for example, against both annular bodies, for example situated or held between them.

Within the scope of the present disclosure, it may also be provided that the chamber forms a through opening for the rod-shaped element over a longitudinally central section, in particular with receptacle radial play (relatively large radial play, compared to the relatively smaller radial play or annular body radial play). The chamber has the above-mentioned dumbbell shape, for example. The divided sub-chambers communicating in this way preferably communicate via the through opening (the (dumbbell) shaft) and may each accommodate one annular body. With such an approach, the chamber may be formed, for example, from more than two housing elements, in particular three housing elements, for example, wherein a longitudinally central housing element advantageously need have only one bore-hole for forming the through opening.

The disclosure also encompasses embodiments of the arrangement in which a sealing element, in particular an O-ring, is situated around the annular body, between a circumferential wall of the chamber and at least one of the annular bodies, in particular each annular body. The sealing element is preferably elastic, and may thus allow any necessary radial displacement of the annular body, wherein the sealing element may also advantageously bring about prepositioning (centering) of the annular body when supported against the annular body as well as the circumferential wall of the chamber, and thus, also centering within the scope of guiding the rod-shaped element through the annular body.

Within the scope of the present disclosure, a fuel injector is also proposed, in particular for operation with a first and a second medium, which preferably may be combustion gas and control fluid, for example control oil (in addition, within the scope of the present disclosure a fuel injector formed as a dual-fuel fuel injector may, for example, also provide the operation with highly pressurized (2000 bar or greater, for example) liquid fuel). The proposed fuel injector has at least one arrangement as described above, wherein the first medium is provided on the first media side and the second medium is provided on the second media side of the arrangement, in particular acted on by pressure (the control oil pressure may, for example, be slightly above the combustion gas pressure (350 bar, for example)).

During injector operation, the first medium may be present at the first receptacle, for example on the side of a combustion gas nozzle space (first media side), and the second medium may be present at the second receptacle, for example on the side of a control fluid control circuit (second media side), for example on the side of a hydraulic piston control system of the fuel injector. Alternatively, the first medium may be present at the first receptacle, for example on the side of a combustion gas store of the fuel injector (first media side), and the second medium may be present at the second receptacle, for example once again on the side of the control fluid control circuit of the fuel injector.

The fuel injector is also preferably configured for operating with a third medium that is provided at the third media side of the arrangement. The third medium is, for example, a barrier fluid for sealing or media separation, also preferably suppliable to the chamber under pressure via the line path. A barrier fluid pressure level is, for example, higher than that on the combustion gas side, for example 5 to 10 percent above the combustion gas pressure. In addition, the control fluid pressure may be 500 bar, for example.

With the fuel injector, a fuel injector arrangement may be formed which in particular is configured to provide the media to the first, second, or also third media side at preset pressure levels. Such a fuel injector arrangement is preferably a dual-fuel fuel injector arrangement, within the scope of which a barrier fluid supply is also provided to the fuel injector, i.e., to the chamber of the arrangement. By means of the barrier fluid, a particular annular body is preferably pressed toward an opening in the chamber to its closure in the above-described manner.

In particular for a reliable displacement of the annular bodies or self-sealing, such a fuel injector arrangement may be configured for initially supplying the medium of the third media side to the fuel injector or the chamber before connecting the first and second media to the fuel injector or the chamber. The openings may thus be sealed before the first and the second medium are applied. For switching off the supply of the media to the fuel injector, the fuel injector arrangement may also be configured for switching off the third medium after the first and second medium, i.e., last.

Further features and advantages of the disclosure result from the following description of exemplary embodiments of the disclosure, with reference to the figures of the drawings which show particulars essential to the disclosure, and the claims. The individual features may in each case be implemented individually or collectively in various combinations in a variant of the disclosure.

Preferred embodiments of the disclosure are explained in greater detail below with reference to the appended drawings, which show the following:

DETAILED DESCRIPTION

Figure 1:
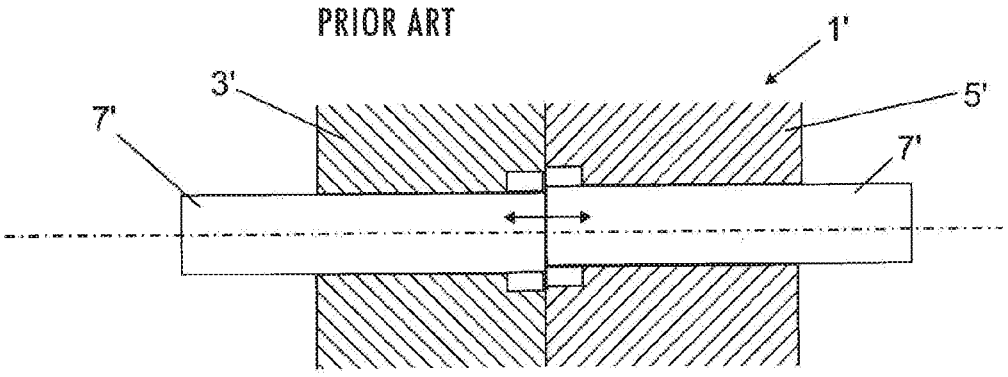
FIG. 1 schematically shows by way of example a view of a fuel injector from the prior art.

In the following description and the drawings, elements having an identical or comparable function are denoted by the same reference numeral. Elements from the prior art are provided with reference numerals with prime symbols (').

FIG. 1 shows a view of a fuel injector 1' from the prior art. The fuel injector has a first housing element 3' and a second housing element 5', each having an axial borehole for guiding a rod-shaped element 7' such as a nozzle needle. To preclude jamming of the rod-shaped element 7', which is guided with small radial play in particular for media separation, for any radial offset of the housing elements 3', 5', the rod-shaped element 7' has a two-part design. However, such an embodiment is complicated to manufacture, and entails the risk of narrow guide gaps clogging over the substantial length.

Figure 2:
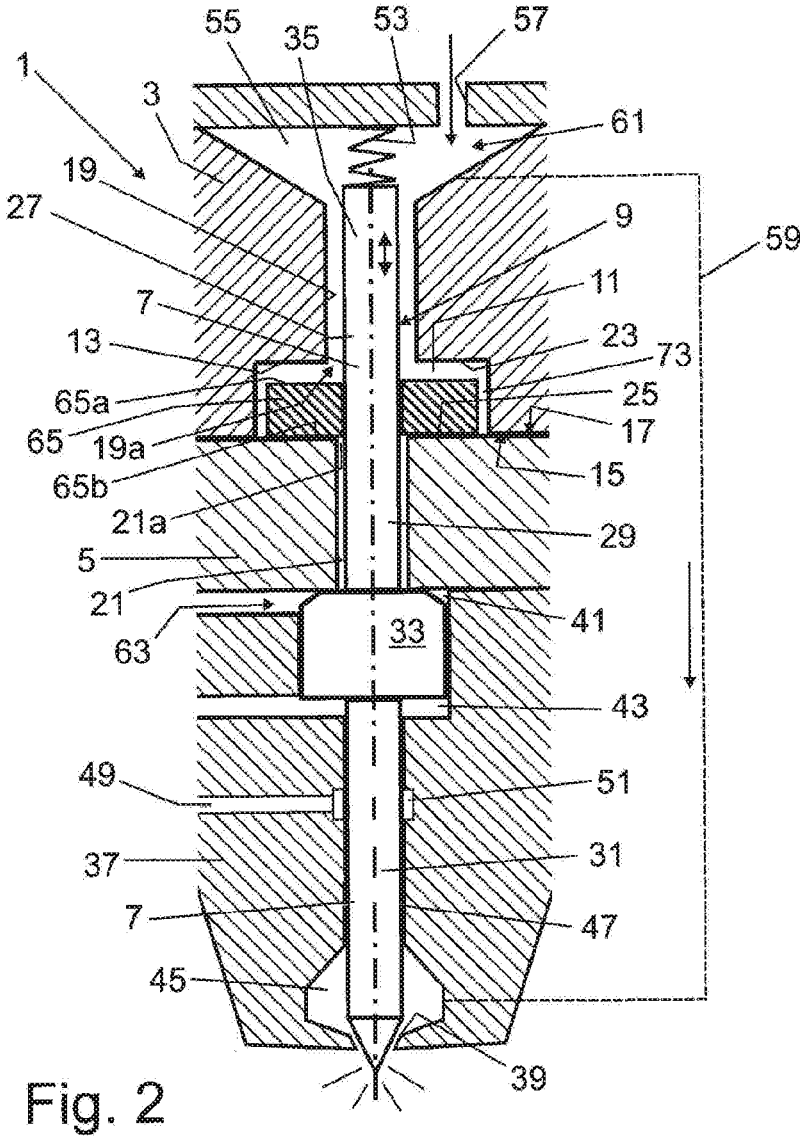
FIG. 2 schematically shows by way of example a fuel injector with an arrangement according to one possible embodiment of the disclosure, in a sectional view.

FIG. 2 shows an arrangement 9 according to the disclosure and a fuel injector 1 formed with same, which is provided as a dual-fuel fuel injector, in the present case for operation with combustion gas and liquid fuel (however, only one combustion gas nozzle valve of the fuel injector 1 is illustrated, in particular of a plurality of combustion gas nozzle valves of the fuel injector 1). The combustion gas nozzle valves may be situated, for example, surrounding a liquid fuel-nozzle valve (not illustrated).

The arrangement 9 includes a chamber 11 or a delimited cavity that is formed by a first housing element 3 of the fuel injector 1 and a second housing element 5 of the fuel injector 1. To form the chamber 11, the first housing element 3 has a recess, in particular a blind hole 13, that is created on the side of an end-face or boundary surface 15 for the second housing element 5 in the first housing element 3; in addition, the second housing element 5 covers the blind hole 13 with its end-face or boundary surface 17, thus completing the chamber 11.

As illustrated in FIG. 2, the chamber 11 is situated or formed between a first (through) receptacle 19 and a second (through) receptacle 21 of the arrangement 9, the receptacles 19, 21 being provided for a rod-shaped element 7; it is apparent that the receptacles 19, 21 open into or open out to the chamber 11 at oppositely situated end-face sides 23, 25, i.e., a first end-face side 23 and a second end-face side 25. The receptacles 19, 21 are each formed as a drilled channel, in particular as an axial borehole. The first receptacle 19 extends in the first housing element 3, and the second receptacle 21 extends in the second housing element 5. A preferably coaxial orientation of the receptacles 19, 21 and of the chamber 11 is provided.

The rod-shaped element 7, as illustrated in FIG. 2 in a somewhat highlighted manner, is accommodated in the receptacles 19, 21 with (relatively large) radial play over each section 27, 29 (one section 27 remote from the nozzles and one section 29 closer to the nozzles), in this regard in particular with receptacle radial play, and in its direction of longitudinal extension passes through the chamber 11. The rod-shaped element 7 is a one-piece element that is formed from a nozzle valve element section 31, a piston section 33, and a stilt section 35. It is apparent that the stilt section 35, in particular having a round rod shape, passes through the chamber 11. However, it is also conceivable to provide one or more of the sections 31, 33, 35 separately from the other sections, so that the rod-shaped element 7 that passes through the chamber 11 is formed only by the stilt section 33, for example.

By means of the nozzle valve element section 31, which acts as a combustion gas nozzle needle and is accommodated in a nozzle body 37 of the fuel injector 1, a combustion gas nozzle system of the fuel injector 1 (not explicitly illustrated) may be opened and blocked, i.e., by appropriate stroke control of the piston section 33 connected to the nozzle valve element section 31. The combustion gas nozzle system has one or more combustion gas nozzle openings, i.e., downstream from a valve seat 39 for the nozzle valve element section 31.

For stroke control of the piston section 33, it may be acted on by, and relieved of, control pressure on two control sides via control chambers 41, 43 of a control circuit of the fuel injector, i.e., hydraulically, to load each control side with pressure while the other control side is relieved of pressure, and vice versa, depending on the operating principle. Control oil, or alternatively liquid fuel, for example, is provided as a pressure-impinged control fluid or control medium for use with the fuel injector 1.

The nozzle valve element section 31 is guided on the side of a combustion gas nozzle space 45 toward the piston section 33, in particular in an axial borehole 47 with continued small radial play, wherein the fuel injector 1 is configured for allowing sealing around the nozzle valve element section 31 to prevent combustion gas from passing into the control circuit, by means of a barrier fluid seal. For this purpose, a barrier fluid line 49 is guided to an annular space 51 that surrounds the nozzle valve element section 31 over one section. If pressure-impinged barrier fluid is suitably supplied to the annular space 51 via the barrier fluid line 49, for example with a pressure level somewhat above the combustion gas operating pressure level, thus activating functioning of the barrier fluid seal, entry of leaking combustion gas into the control circuit during injector operation may be effectively prevented.

The stilt section 35 continues the piston section 33 toward the side of the fuel injector 1 remote from the nozzle, wherein the rod-shaped stilt section 35 is provided, in cooperation with a spring-elastic element 53, in particular a coil compression spring, for introducing a closing force to the rod-shaped element 7 remote from the nozzle, i.e., to ensure reliable retention of the closed position for a pressureless injector 1 and to assist the closing operation of the nozzle valve element section 31 within the scope of closing stroke movements. Remote from the nozzle, the stilt section 35 dips into a combustion gas store 55 of the fuel injector 1, which is preferably used as a flowthrough store inside the injector. A combustion gas line 57 of the fuel injector may flow through the combustion gas store 55. (Highly) pressurized combustion gas may be supplied, for example, to the combustion gas nozzle space 45 by the combustion gas store 55 (via a further line 59 of the fuel injector, illustrated as a dashed line by way of example).

In the arrangement 9 thus formed, it is apparent that the arrangement has a first media side 61 and a second media side 63, each of which is connected to the chamber 11 or communicates with the chamber 11 via a receptacle 19, 21, respectively, i.e., the first receptacle 19 and second receptacle 21. The first media side 61 is formed by the combustion gas store 55, which communicates with the chamber 11 via the first receptacle 19 (via the annular gap around the rod-shaped element 7); i.e., the first media side 61 is a combustion gas side. The second media side 63 is formed by the hydraulic control circuit, in particular the control chamber 41 thereof, which likewise communicates with the chamber 11 via the second receptacle 21 (once again via the annular gap around the rod-shaped element 7); i.e., the second media side 63 is a control fluid side.

As further illustrated in FIG. 2, the arrangement 9 also has an annular body 65 that is situated in the chamber 11 and surrounds the rod-shaped element 7 with (relatively less) radial play, in this regard in particular annular body radial play, or through which the rod-shaped element 7 with (relatively less) radial play, in this regard the annular body radial play, passes, i.e., with less radial play than is allowed the rod-shaped element 7 in the receptacles 19, 21 (receptacle radial play). The radial play or the annular body radial play is preferably small enough that passage of media is essentially prevented, and a (sliding) seal on (around) the rod-shaped element 7 is thus achieved. The annular body 65 is also longitudinally displaceable in the chamber 11, independently of the rod-shaped element 7, and provided, in particular acted on by media pressure (impinged by the media pressure of at least one of the media of the media sides 61, 63), to come into contact with an end-face side 23, 25 of the chamber 11 (and to seal against media entry into the chamber 11 at the associated opening cross section or the associated opening 19*a*, 21*a*).

In the embodiment of the arrangement 9 shown in FIG. 2, the annular body 65 has a disk shape, i.e., is designed as a (cylindrical) disk. A first end face 65*a* faces the combustion gas side (first media side 61), and the other end face 65*b* faces the control fluid side (second media side 63). Both end faces 65*a*, 65*b*, which have a flat design, are able to seal against an end-face side 23 or 25 of the chamber 11, i.e., at the respective opening 19*a*, 21*a* of a receptacle 19, 21, during displacement.

In order to press the annular body 65 against one or the other end-face side 23, 25 of the chamber 11 during injector operation, and thus achieve the intended self-sealing or media separation between the media sides 61, 63, within the scope of the present disclosure it is provided in particular to create a pressure drop across the end faces 65*a*, 65*b* of the annular body 65, preferably by media pressure impingement. In particular independently of the initial position of the annular body 65 in the chamber 11, when the fuel injector 1 starts operation the annular body may, for example, be pressed against an end-face side 23, 25, so that the connection of the media to the first media side 61 and the second media side 63 takes place with a time offset. When only one medium is initially connected, for example on the combustion gas side, the annular body 65 thus experiences a one-sided pressure force impingement on this media side 61, and is subsequently pressed toward the opening 21*a* of the receptacle 21 of the other media side 63, in the present example, toward the opening 21*a* of the receptacle 21 of the control fluid side.

If the further medium, in the present case the control fluid, for example, is then connected, the annular body 65 at this end face 65*a* now provides an effective pressure surface area for the further medium (control fluid), which is reduced to the circular surface area that overlaps with the opening 21*a* (in the direction of longitudinal extension of the rod-shaped element 7), while at the opposite end face the entire effective pressure surface area is available for introduction of pressure. A pronounced pressure drop between the end faces 65*a*, 65*b* of the annular body 65 may thus be continuously achieved, by means of which it is possible not only to secure the position of the annular body 65 in sealing contact with the end-face side 25 of the chamber 11, but also to achieve a pressure force that allows the (limited) introduction of transverse forces into the associated housing element 5 via the end-face side 25, and thus, the intended precisely positioned guiding of the rod-shaped element 7 through the annular body 65.

However, as a result of the annular body 65 also being allowed (sufficient) radial play with respect to the circumferential wall of the chamber 11 (in this regard an annular body 65 supported in a floating manner), a radial offset of guides 47 or receptacles 19, 21 along the rod-shaped element 7 may also advantageously be easily compensated for if necessary, i.e., by appropriate transverse force-related displacement of the annular body 65.

With the proposed arrangement 9, self-sealing is also advantageously achieved during operation of the fuel injector 1, even if one of the media pressure levels falls below a setpoint pressure. If the pressure drop across the annular body 65 reverses, according to the disclosure this is generally sufficient to move the annular body 65 toward the other end-face side 23 and bring it into sealing contact there. The media separation is thus always reliably ensured.

For further influencing or setting an intended displacement and pressing characteristic of the annular body 65, as illustrated in FIG. 2, the free opening cross section at the opening 19*a*, 21*a* of the receptacle 19, 21 on a media side 61, 63 may also be selected to be different from that of the second media side 63, 61, so that the effective pressure surface areas may be set in a targeted manner upon contact with one or the other end-face side 23, 25. In addition, one end face 65*a*, 65*b* may, for example, have a larger surface than the other end face 65*b*, 65*a*, for example may have a bevel (with a (circumferential) bevel, with media pressure impingement it is also advantageously possible, for example, to facilitate self-centering of the annular body 65 in the chamber 11).

Figure 3:
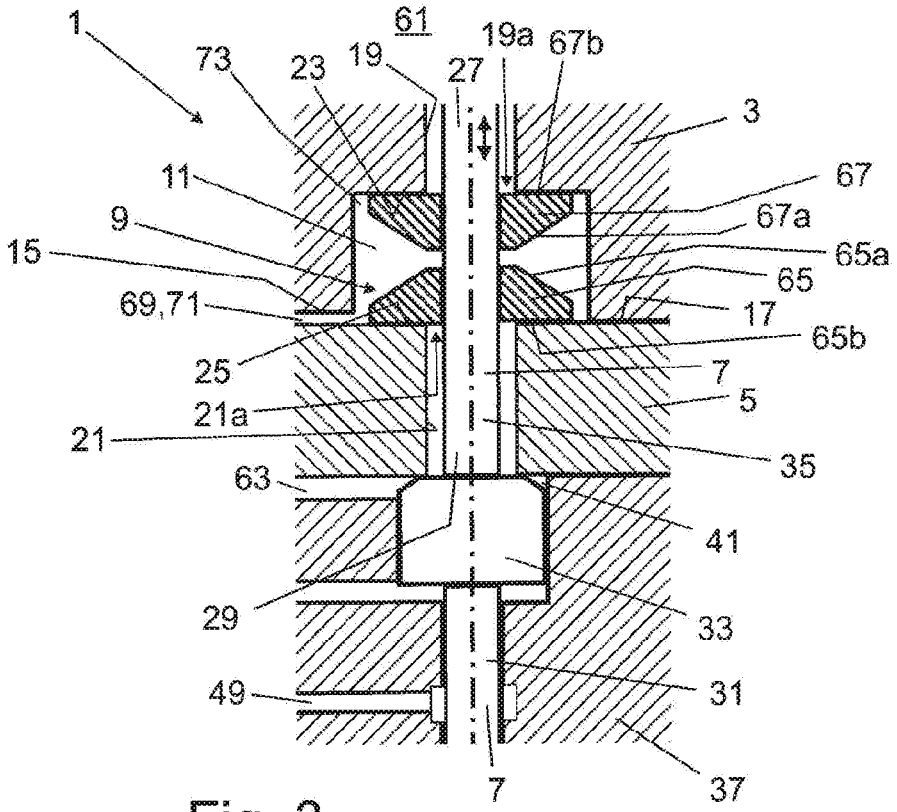
FIG. 3 schematically shows by way of example a fuel injector with an arrangement according to another possible embodiment of the disclosure, in a cutaway sectional view.

FIG. 3 shows a cutaway sectional view of a fuel injector 1 in which, in contrast to the embodiment according to FIG. 2, the arrangement 9 has a further annular body 67, which is situated in the chamber 11 and surrounds the rod-shaped element 7 with (relatively less) radial play, in this regard in particular annular body radial play, and through which the rod-shaped element 7 passes with annular body radial play, i.e., once again with lesser radial play than allowed for the rod-shaped element 7 in the receptacles 19, 21 (receptacle radial play). The further (second) annular body 67 is situated opposite from the annular body 65 (first annular body 65) in the direction of passage (from end-face side to end-face side) or the direction of longitudinal extension.

In this embodiment, the radial play (annular body radial play) of both annular bodies 65, 67 is preferably small enough that passage of media is essentially prevented, and a (sliding) seal on (around) the rod-shaped element 7 is thus achieved at both annular bodies 65, 67.

Also in contrast to the embodiment of the arrangement according to FIG. 2, the arrangement 9 in the embodiment according to FIG. 3 has a third media side 69 that communicates with the chamber 11 or is connected thereto via a line path 71 of the arrangement 9 provided for this purpose. The line path 71 is radially guided to the chamber 11, for example formed as a groove in the end-face surface 15 of the first housing element 3, or, for example, formed in each case by a groove in the adjoining end-face surfaces 15, 17 of the housing elements 3, 5, once again advantageously resulting in ease of manufacturability.

Within the scope of this embodiment, the further annular body 67 is also longitudinally displaceable in the chamber 11, independently of the rod-shaped element 7, and provided, in particular acted on by media pressure, to come into contact with an end-face side 23 of the chamber 11 or to be pressed against an end-face side 23 (and to seal against media entry into the chamber 11 at the associated opening 19*a*). Thus, within the scope of the media pressure impingement, a particular annular body 65, 67, (suitably) acted on by the media pressure of at least one of the media on the media sides 61, 63, 69, may also come into contact with or be pressed against an end-face side 23 of the chamber 11 and seal against media entry into the chamber 11 at the associated opening 19*a*.

The third media side 69 is a barrier fluid side that is formed by a barrier fluid circuit at the fuel injector 1. The medium of the third media side 69 is a barrier fluid, in particular barrier oil, that is acted on by pressure, for example provided at an operating pressure level that is somewhat higher than the operating pressure level of the combustion gas side, for example 5 percent to 10 percent above same, for example 380 bar. In particular, a barrier fluid seal may also be supplied with barrier fluid via the barrier fluid circuit, as with the embodiment described according to FIG. 2.

In the embodiment of the arrangement 9 shown in FIG. 3, it is apparent that the annular bodies 65, 67 have a beveled end face 65*a*, 67*a*, respectively, which points in the direction of the respective other annular body 67, 65, and opposite from same have a flat contact surface 65*b*, 67*b*, respectively, which points toward an adjacent end-face side 25 or 23, respectively, of the chamber, against which the particular contact surface 65*b*, 67*b* is able to seal. The beveled end face 65*a*, 67*a* has an enlarged surface in the sense of a pressure shoulder, and is provided to influence (in the desired manner) the displacement and pressing characteristic of the annular body under media pressure impingement on the chamber. In addition, once again self-centering is facilitated.

In this embodiment of the fuel injector 1, in order to achieve sealing at both end-face sides 23, 25 of the chamber 11 (at the openings 19*a*, 21*a*) during injector operation by means of the arrangement 9, it is provided for the chamber 11 to be acted on by the pressure-impinged medium of the third media side 69, i.e., the barrier fluid, over the line path 71. Individual aspects of this arrangement 9, in particular in conjunction with the media pressure impingement, will now be discussed in greater detail.

If media pressure is no longer present at the fuel injector 1 or the third media side 69, the annular bodies 65, 67 may, for example, be situated in the chamber 11 in an undefined manner. If the barrier fluid is now switched on first, i.e., conducted to the chamber 11, the annular bodies 65, 67 are acted on by the barrier fluid pressure (when the contact surface 65*b*, 67*b* of a particular annular body 65, 67 is exposed, media pressure may act on the annular body from all sides, in a manner of speaking, via the radial gap 73 provided in each case with respect to the circumferential wall of the chamber 11); however, due to the surface area ratios of the contact surface 65*b*, 76*b* to the pressure shoulder surface 65*a*, 67*a*, a resultant pressure force always actively develops on the annular body 65, 67, which presses the annular body in the direction of the adjacent end-face side 25, 23; i.e., the annular bodies 65, 67 are pushed apart.

With such an embodiment, in this regard it may be provided to initially connect the medium of the third media side 69 to the fuel injector 1 or the arrangement 9, followed by those of the first media side 61 and the second media side 63. If the annular bodies 65, 67 then rest against the end-face sides 25, 23, they are subsequently acted on by media pressure, i.e., the pressure drop between the pressure shoulder surface 65*a*, 67*a* and the contact surface 65*b*, 67*b*, via the relatively small-surface opening cross sections 21*a*, 19*a* on the side of the receptacles 21, 19 of the first media side 61 and second media side 63 at the contact surfaces 65*b*, 67*b*, and the contact force against the particular end-face side 25, 23 thus remains pronounced. Reliable self-sealing by means of the annular bodies 65, 67, which once again are supported in a floating manner, is thus continuously achievable.

In addition, the respective annular bodies 65, 67, as in the embodiment according to FIG. 2, may experience a large, media pressure-related contact force against the end-face sides 25, 23 in such a way that the (limited) introduction of transverse forces into the particular housing elements 5, 3 is made possible via the respective annular bodies 65, 67 (as previously in the embodiment according to FIG. 2), as well as radial fixing of the annular bodies 65, 67 and thus, guiding of the rod-shaped element 7 (which may advantageously be guided over two sections). The contact pressure may also be easily influenced by controlling the barrier fluid pressure. However, in this embodiment, as a result of the annular bodies 65, 67 also once again each being allowed radial play in the chamber 11 (via the particular (circumferential) radial gap 73), a radial offset between the individual housing elements 3, 5 or also the nozzle body 37 may be compensated for if necessary (if the absorbable transverse forces are exceeded), i.e., by appropriate radial displacement of the particular annular body 65, 67 in the chamber 11.

In this embodiment, self-sealing at the first opening 19*a* or second opening 21*a* during injector operation is likewise advantageously ensured, even if the pressure is not sufficient at the third media side 69. In such a case, a temporary overpressure at one media side 61, 63, for example due to a pressure drop at the other media side 63, 61 (in particular within the scope of an injection operation, for example), which can press the two annular bodies 65, 67 against the respective oppositely situated end-face side 23, 25, would once again allow self-sealing.

Figure 4:
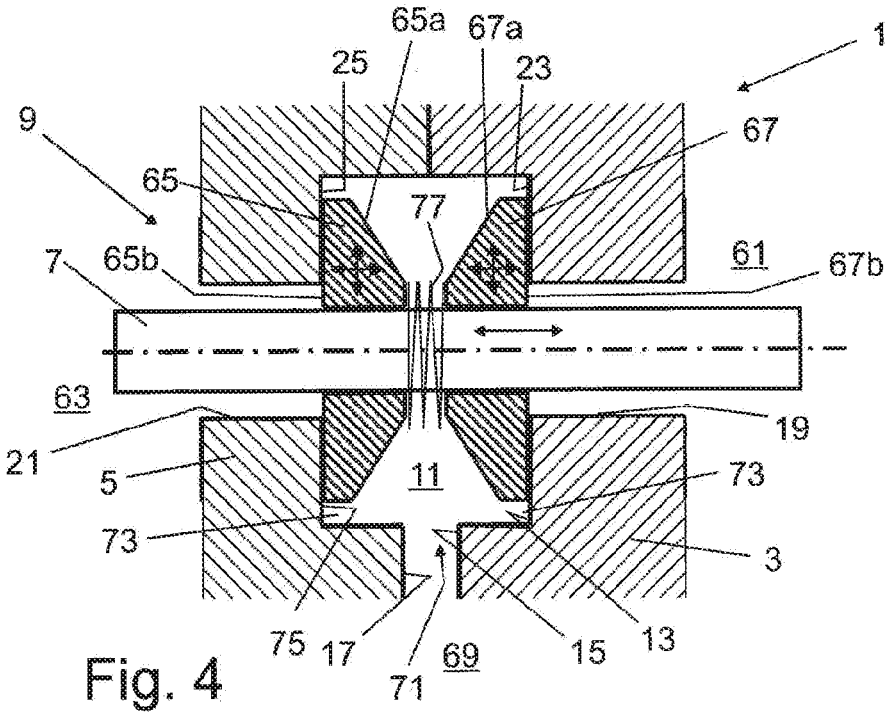
FIG. 4 schematically shows by way of example an arrangement for a fuel injector according to yet another possible embodiment of the disclosure, in a sectional view.

FIG. 4 shows another advantageous embodiment of an arrangement 9 for a fuel injector 1 that is formed essentially analogously to the embodiment according to FIG. 3, i.e., by means of two annular bodies 65, 67. In contrast to the preceding embodiment, in the arrangement 9 shown in FIG. 4 the chamber 11 is formed by two recesses or depressions 13, 75, in particular blind holes, which are each created in one of the oppositely situated boundary surfaces 15, 17 of the housing elements 3, 5. This also advantageously results in ease of manufacturability of the arrangement 9, in particular also with regard to the guiding of the line path 71 to the chamber 11, which likewise may be easily created in one or both of the boundary surfaces 15, 17, for example once again as a groove. In such an embodiment of the arrangement 9, the line path 71 may, for example, be advantageously guided (longitudinally) centrally to the chamber 11, so that a quasi-symmetrical pressure distribution may be achieved when flow passes through the chamber 11 via the line path 71.

As also illustrated in FIG. 4 by way of example, in this arrangement 9 the rod-shaped element 7 has a bolt shape, for example, provided as a separate stilt section, for example. In particular to define the position of the annular bodies 65, 67, even for a pressureless arrangement 9 or a pressureless fuel injector 1, the arrangement 9 according to FIG. 4 also has a compression spring 77, i.e., in particular a force-exerting means or a source of force for introducing force into the annular bodies 65, 67 independently of media pressure, the compression spring 77 being situated between the annular bodies 65, 67 and pushing them apart. In a pressureless arrangement 9, the annular bodies 65, 67 thus already rest with their respective contact surface 65*b*, 67*b* against an end-face side 25, 23.

Figure 5:
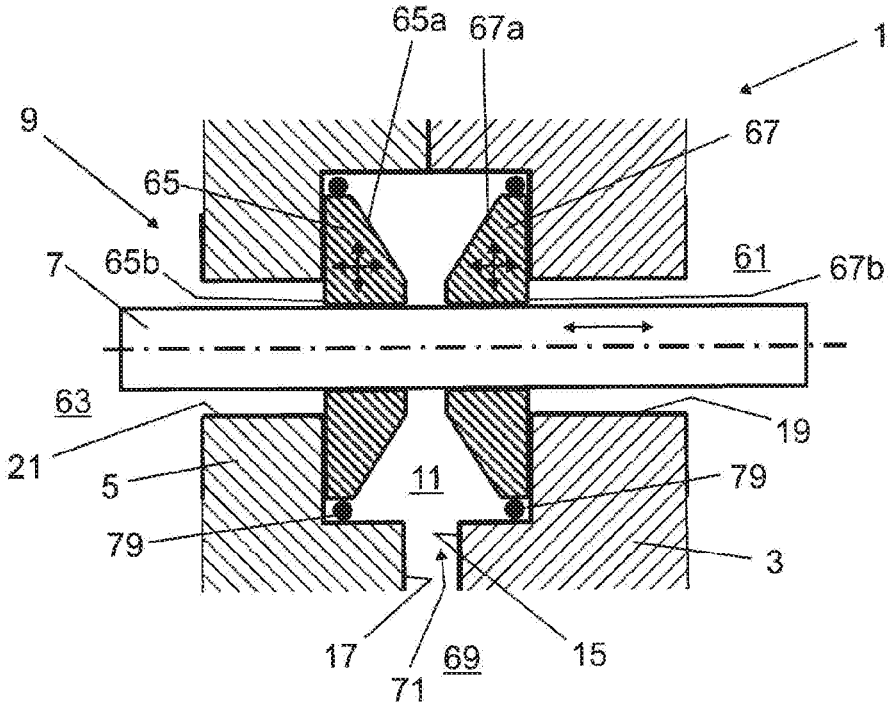
FIG. 5 schematically shows by way of example an arrangement of a fuel injector according to yet another possible embodiment of the disclosure, in a sectional view.

FIG. 5 shows one embodiment of the arrangement 9 in which an annular seal 79 is situated in each case between the circumferential wall of the chamber 11 and the circumferential sides of the annular bodies 65, 67. The annular seals 79 ensure reliable contact of the annular bodies 65, 67 when the barrier oil is switched on, in that generally only the pressure shoulder surfaces 65*a*, 67*a* experience the barrier fluid pressure, while the contact surfaces 65*b*, 67*b* are decoupled from the barrier fluid pressure via the seals 79. At the same time, in this embodiment the annular bodies 65, 67 are likewise allowed radial play, which is made possible by the elasticity of the annular seals 79. In addition, in this arrangement 9 a spring element 77 (force-exerting means or source of force), for example, may once again be provided between the annular bodies 65, 67.

Figure 6:
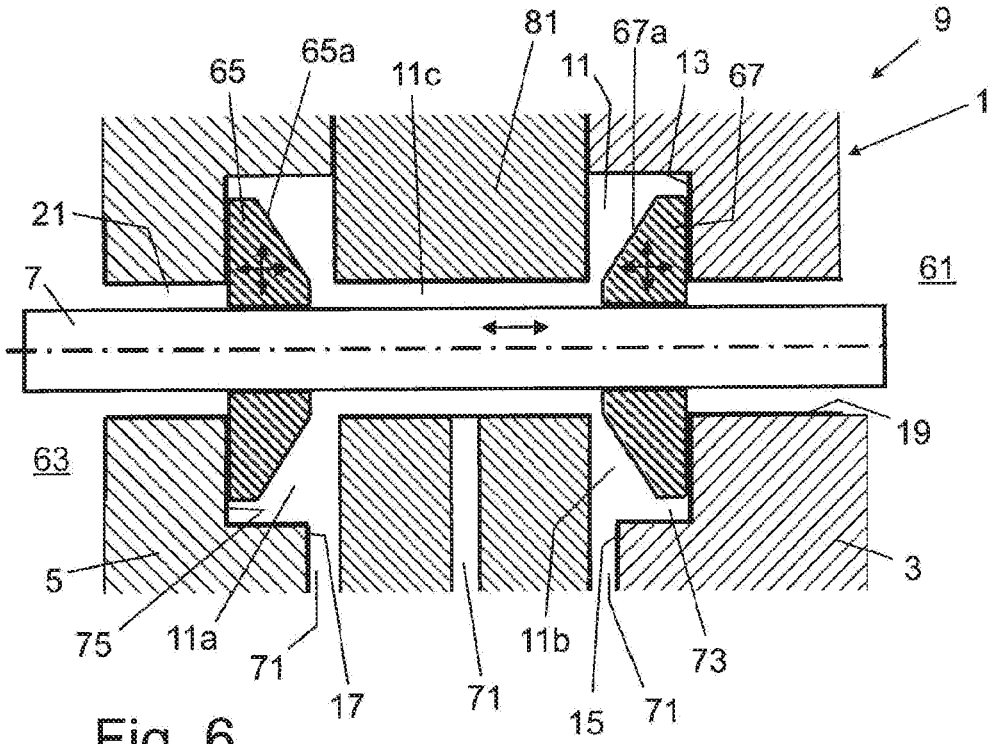
FIG. 6 schematically shows by way of example an arrangement of a fuel injector according to yet another possible embodiment of the disclosure, in a sectional view.

FIG. 6 shows yet another embodiment of the arrangement 9 in which the chamber 11 has a dumbbell shape, i.e., with a first chamber part 11*a* and a second chamber part 11*b* which are in communicating connection via the dumbbell shaft 11*c*, formed by a through opening. In this embodiment, the chamber 11 is formed by three housing elements 3, 5, 81, wherein the first housing element 3 and the second housing element 5 once again have a recess 13, 75, respectively, or a blind hole in a respective boundary surface 15, 17 to form the chamber 11 in which an annular body 65, 67 is accommodated in the respective chamber parts 11*a*, 11*b* thus formed. It is apparent that in the third housing element 81, accommodated between the first housing element 3 and the second housing element 5, it is necessary only to provide the through opening 11*c*, which may be easily designed as a borehole through the third housing element 81.

In this embodiment, the line path 71 on the side of the third media side 69, as collectively illustrated for the different approaches in FIG. 6, may advantageously be easily created in a boundary surface of one of the housing elements 3, 5, 81 or also in more than one boundary surface of the housing elements 3, 5, 81, also, for example, as a (drilled channel) through the third housing element 81, for example, which once again is radially guided to the chamber 11 by way of example.

Although not explicitly illustrated, within the scope of the disclosure a fuel injector 1 may have an arrangement 9 as described above with reference to FIGS. 2 through 6, for example also at a nozzle valve element section 31, for example as an alternative or in addition to a barrier fluid seal. In addition, an arrangement 9 according to the disclosure may be formed, for example, on an anchor rod of the fuel injector 1, for example a pilot valve of the fuel injector 1, wherein the anchor rod forms the rod-shaped element 7. In addition, further applications of the arrangement 9 on the fuel injector 1 may be considered which are possible in the individual case.

With the fuel injector 1, a method is also proposed in which the medium of the third media side 69 is first switched to the receptacle for the injector operation, followed by the other media of the first media side 61 and second media side 63. Such a method may be carried out, for example, with a fuel injection device that is suitably configured for controlling the process, or an internal combustion engine having such a fuel injector 1.

LIST OF REFERENCE NUMERALS

1, 1' fuel injector
3, 3' first housing element
5, 5' second housing element
7, 7' rod-shaped element
9 arrangement
11 chamber
11*a* first chamber part
11*b* second chamber part
11*c* shaft
13 blind hole
15 end-face surface
17 end-face surface
19 first (through) receptacle
19*a* opening
21 second (through) receptacle
21*a* opening
23 first end-face side
25 second end-face side
27 section (remote from nozzle)
29 section (closer to nozzle)
31 nozzle valve element section
33 piston section
35 stilt section
37 nozzle body
39 valve seat
41 control chamber (remote from nozzle)
43 control chamber (closer to nozzle)
45 combustion gas nozzle space
47 axial borehole
49 barrier fluid line

51 annular space
53 spring-elastic element
55 combustion gas store
57 combustion gas line
59 further line
61 first media side
63 second media side
65 annular body
65*a* first end face
65*b* second end face
67 further annular body
67*a* first end face
67*b* second end face
69 third media side
71 line path
73 radial gap
75 blind hole
77 (compression) spring
79 annular seal
81 third housing element

The invention claimed is:

1. An arrangement comprising:

a chamber that is at least partly defined by:

a first receptacle defined by a first receptacle wall and open to the chamber on a first end-face side of the first receptacle, and a second receptacle defined by a second receptacle wall, different from the first receptacle, open to the chamber on a second end-face side of the second receptacle, opposite the first end-face side, an annular body that is arranged in the chamber with a first annular body radial play between the annular body and at least one of the first receptacle wall and the second receptacle wall and a rod-shaped element, arranged in the first receptacle through a first respective section defined by the first receptacle wall, with a first receptacle radial play between the rod-shaped element and the first receptacle wall, and arranged in the second receptacle through a second respective section defined by the second receptacle wall, with a second receptacle radial play between the rod-shaped element and the second receptacle wall, and the rod-shaped element passing through the annular body with a second annular body radial play less than the first receptacle radial play and the second receptacle radial play, wherein the arrangement has a first media side and a second media side that are connected to the chamber via the first receptacle and second receptacle, respectively, and wherein the annular body is configured to be pressed into floating contact against at least one of the first end-face side or a second end-face side of the second receptacle opposite the first end-face side.

2. The arrangement of claim 1, wherein the annular body, acted on by media pressure, is configured to be pressed against at least one of the first end-face side or the second end-face side and supported thereon in a floating manner.

3. The arrangement of claim 1, further comprising a further annular body that is arranged in the chamber and through which the rod-shaped element passes with the first annular body radial play, wherein the further annular body is arranged opposite from the annular body in the direction from the first end-face side to the second end-face side wherein the annular body is configured to be pressed into contact against at least one of the first end-face side and the second end-face side by media pressure and supported in a floating manner, and wherein the further annular body is configured to be pressed into contact against at least one of the first end-face side and the second end-face side by media pressure and supported in a floating manner.

4. The arrangement of claim 3, wherein at least one of the annular body and the further annular body has a contact surface at one of the first end-face side or the second end-face side, and has a pressure shoulder surface having a larger surface than the contact surface, at the other of the first end-face side or the second end-face side.

5. The arrangement of claim 3, further comprising a spring which, independently of media pressure, is configured to press at least one of the annular body and the further annular body into contact against at least one of the first end-face side and the second end-face side, or a spring-elastic element arranged in the chamber and configured to be pressed against the annular body or the further annular body.

6. The arrangement of claim 1, further comprising a line path that is guided to the chamber, via which the chamber is connected to a third media side of the arrangement, wherein the line path is radially guided to the chamber.

7. The arrangement of claim 1, wherein the chamber defines a through opening for the rod-shaped element configured to define the first receptacle radial play, through a longitudinally central section.

8. The arrangement of claim 1, further comprising a sealing element arranged around the annular body, between a circumferential wall of the chamber and the annular body.

9. The arrangement of claim 1, wherein the first media side is configured to be provided with a first medium, and the second media side of the arrangement is configured to be provided with a second medium.

10. The arrangement of claim 9, wherein the rod-shaped element comprises at least one of a stilt section and a nozzle valve element section that passes through the chamber.

11. The arrangement of claim 9, further comprising a line path that is guided to the chamber, through which the chamber is connected to a third media side of the arrangement, wherein the line path is radially guided to the chamber wherein the arrangement is configured for operation with a third medium that is provided at the third media side of the arrangement.

12. The arrangement of claim 11, wherein the arrangement is configured for pressing, by pressurization of the third medium of the third media side, the annular body and a further annular body of the arrangement during injector operation toward an opening of the first receptacle or an opening of the second receptacle to close same.

13. The arrangement of claim 9, wherein the first medium at the first media side, and the second medium at the second media side are provided at different pressure levels or with a time delay when the arrangement starts operation.

14. An internal combustion engine, comprising an arrangement comprising:

a chamber that is at least partly defined by:

a first receptacle defined by a first receptacle wall and open to the chamber on a first end-face side of the first receptacle, and a second receptacle defined by a second receptacle wall, different from the first receptacle, open to the chamber on a second end-face side of the second receptacle, opposite the first end face side, an annular body that is arranged in the chamber with a first annular body radial play between the annular body and at least one of the first receptacle wall and the second receptacle wall, and a rod-shaped element, arranged in the first receptacle through a first respective section defined by the first receptacle wall, with a first receptacle radial play between the rod-shaped element and the first receptacle wall, and arranged in the second receptacle through a respective second section defined by the second receptacle wall, with a second receptacle radial play between the rod-shaped element and the second receptacle wall, and the rod-shaped element passing through the annular body with a second annular body radial play less than the first receptacle radial play and the second receptacle radial play;

wherein the arrangement has a first media side and a second media side that are connected to the chamber via the first receptacle and second receptacle, respectively; and wherein the annular body is configured to be pressed into floating contact against at least one of the first end-face side or a second end-face side of the second receptacle opposite the first end-face side.

15. A method comprising:

starting an injector operation with an injector comprising an arrangement comprising:

a chamber that is at least partly defined by:

a first receptacle defined by a first receptacle wall and open to the chamber on a first end-face side of the first receptacle, and a second receptacle defined by a second receptacle wall, different from the first receptacle, open to the chamber on a second end-face side of the second receptacle, opposite the first end face side, an annular body that is arranged in the chamber with a first annular body radial play between the annular body and at least one of the first receptacle wall and the second receptacle wall, and a rod-shaped element, arranged in the first receptacle through a first respective section defined by the first receptacle wall, with a first receptacle radial play between the rod-shaped element and the first receptacle wall, and arranged in the second receptacle through a respective second section defined by the second receptacle wall, with a second receptacle radial play between the rod-shaped element and the second receptacle wall, and the rod-shaped element passing through the annular body with a second annular body radial play less than the first receptacle radial play and the second receptacle radial play; and a line path that is guided to the chamber, through which the chamber is connected to a third media side of the arrangement, wherein the line path is radially guided to the chamber wherein the injector is configured for operation with a third medium that is provided at the third media side of the arrangement;

wherein the arrangement has a first media side configured to be provided with a first medium and a second media side configured to be provided with a second medium that are connected to the chamber via the first receptacle and second receptacle, respectively; and wherein the annular body is configured to be pressed into floating contact against at least one of the first end-face side or the second end-face side;

switching the third medium of the third media side to the arrangement;

switching the first medium of the first media side after switching the third medium of the third media side; and switching the second medium of the second media side after switching the first medium of the first media side.

* * * * *